US005579605A

United States Patent [19]

Tanaka

[11] Patent Number: 5,579,605

[45] Date of Patent: Dec. 3, 1996

[54] DOUBLE DOOR

[76] Inventor: Shunji Tanaka, 6-29-1-501 Nakanoshima Tama-Ku, Kawasaki, Japan, 214

[21] Appl. No.: 318,102

[22] Filed: Oct. 5, 1994

[30] Foreign Application Priority Data

Oct. 8, 1993 [JP] Japan ..... 5-277816

[51] Int. Cl.[6] ..... E06B 7/28

[52] U.S. Cl. ..... 49/171

[58] Field of Search ..... 49/163, 169, 171, 49/394

[56] References Cited

U.S. PATENT DOCUMENTS 4,001,970 1/1977 Miyamoto ..... 49/171

4,523,408 6/1985 McConnell ..... 49/171 X

FOREIGN PATENT DOCUMENTS 1708196 12/1969 Germany ..... 49/171

226332 12/1924 United Kingdom ..... 49/171

*Primary Examiner*—Kenneth J. Dorner

*Assistant Examiner*—Jerry Redman

[57] ABSTRACT

An entrance door for office or residence that has a main door equipped with a sub door where the main door is set locked when the sub door is opened. Dimension of the sub door is selected as big enough for article transfer through it and small enough for avoiding human being invasion.

1 Claim, 2 Drawing Sheets

DOUBLE DOOR

BACKGROUND OF THE INVENTION

This invention is related to secured entrance door used for office or residence.

For security purpose, door chains and/or peeping hole are used for entrance door of office and residence. Such apparatus is expected that people take care for strangers before opening the door. However, when opening the door after recognizing that the stranger is harmless, the entrance has no protection at all.

If a malicious visitor pretends a postman who deliver postal parcels, or a money collector, eye hole or door chains is useless, because article transfer through half-closed door with door chains is very restricted and almost impossible. Ordinary people readily open the door when they recognize someone outside the door just wants to give a reasonable article and need a signature. This security defect of entrance door is based on the fact that a conventional door lacks safe article transfer function with preventing forced entry of human beings.

SUMMARY OF THE INVENTION

The present invention solves the above problem by a sub door equipped in a main door with a main-door lock driven by the sub door movement.

DESCRIPTION OF THE PREFERRED EMBODIMENT

Figure 1:
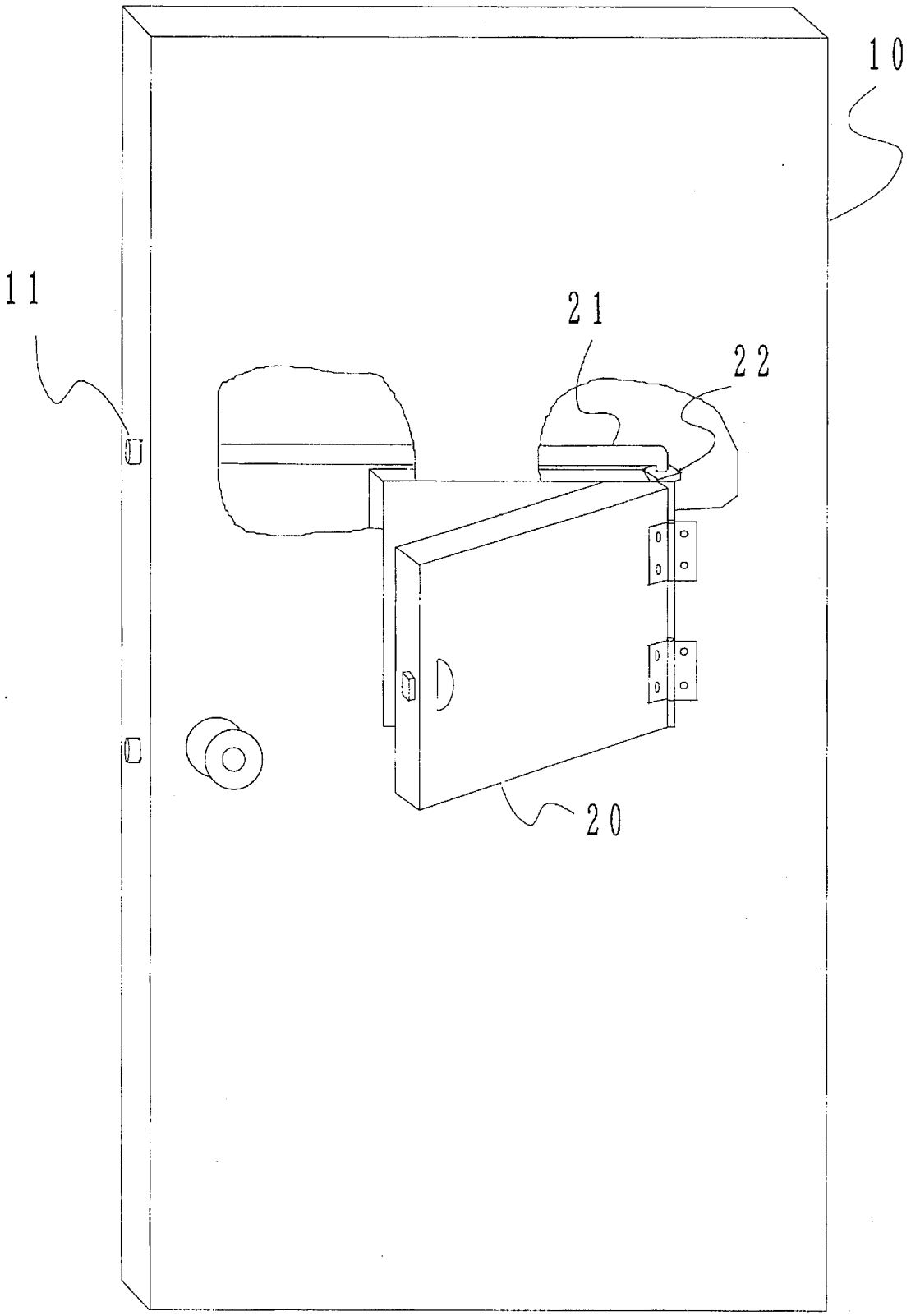
FIG. 1: an example of the present invention shows a main door, bolt, subdoor, link rod, and a link cam.
Figure 2:
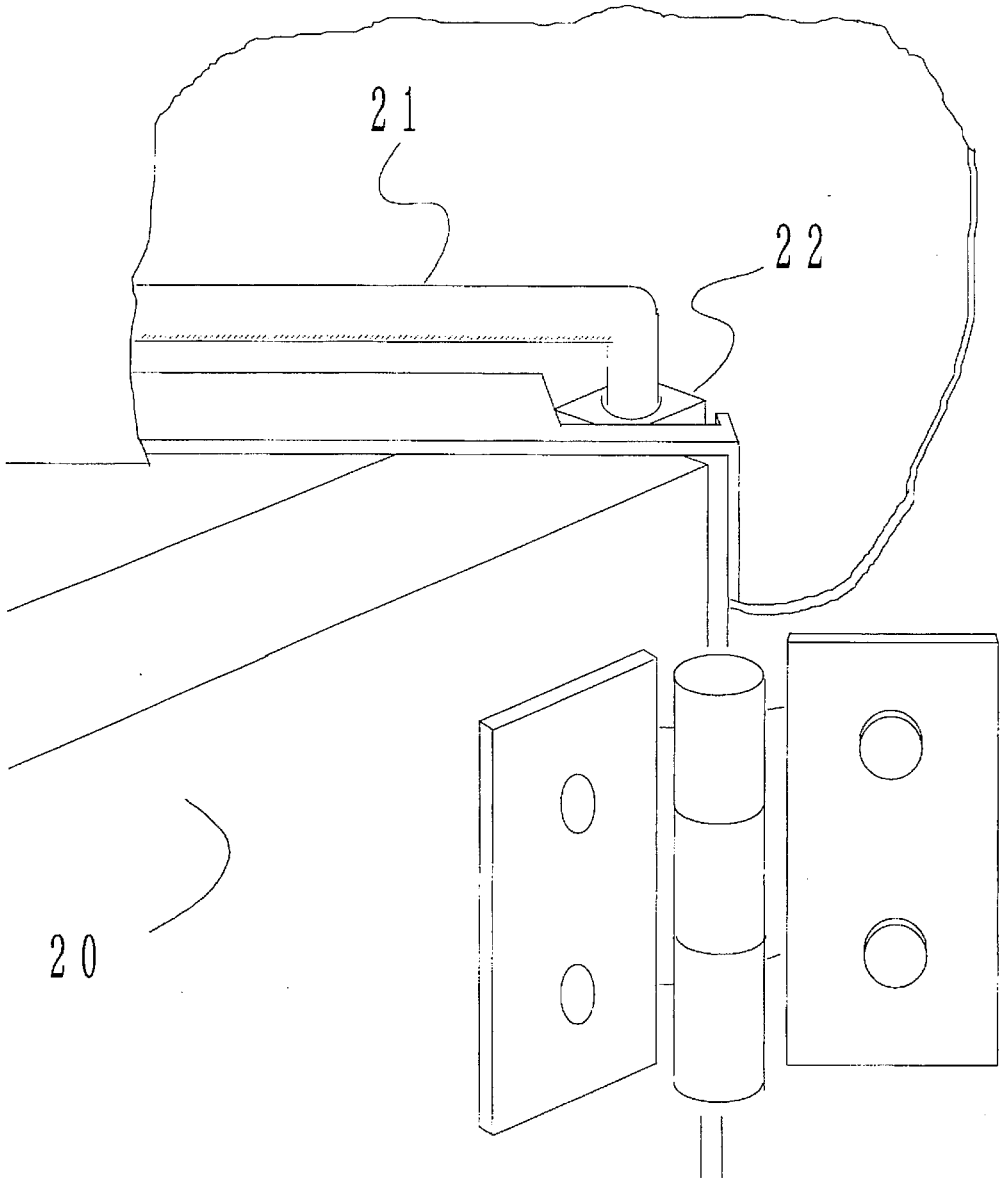
FIG. 2: detail view of lock link between a main door and a sub door.

In this example a main door 10 that has one sub door 20 is indicated in FIG. 1. The main door 10 is installed on a wall at right hand side and can be opened inside by pulling the knob at left hand side. The sub door 20, which is hingely mounted within the opening, is also open at left hand side. When one opens the sub door 20, the link cam 22 installed on the sub door 20 moves and pushes link rod 21. The link rod 21 pushes the main door bolt 11 which projected in the door jamb (not shown), and therefore, the main door has been locked. FIG. 2 indicates the details of connection of link cam 22 and link rod 21. The rotation movement of the sub door and link cam 22 is converted into reciprocal movement by the link rod 21. In this example, the link is realized mechanically, but an electrical link can be easily realized and provides same effects. In electrical case where doors are always locked like guest rooms at most hotels, for example, opening a sub door may cut off the electric current of the main door unlock function. Thus, forced invasion is prevented when the sub door open.

When a stranger appears, a sub door is used for article handling and transfer of invoice and receipt, and resident may not open the main door in many cases. A size of the sub door is selected big enough for article handling through it and small enough for disabling the entry of human being through it. Thus, even when a visitor pretends an article deliverer, the double door prevents invasion and robbery. If the stranger brings his hand through the sub door to unlock the main door, his effort is in vain because the main door can not be unlocked unless the sub door is closed. Prompt opening of sub door avoids impoliteness or embarrassment to a goodwill solicitor while keeping security.

A reverse lock link that locks and keeps the sub door closed when main door is opened, is useful for safety reason, because opened sub door is dangerous when the main door is opened. Furthermore, a sub door can be designed open downward or slide parallel with main door. A downward sub door can be used as a temporary article table when opened and stopped horizontally.

I claim:

1. A door comprising:

a main door having an opening;

a sub-door hingely mounted within said opening of said main door;

a link cam connected to said sub-door;

and a link rod slidably connected to said link cam;

wherein upon pivotal movement of said sub-door, said link cam slidably moves said link rod to extend passed an outer edge of said main door thereby locking said main door.

* * * * *